US006181873B1

(12) United States Patent
Friedheim

(10) Patent No.: US 6,181,873 B1
(45) Date of Patent: Jan. 30, 2001

(54) SUPERHEATED VAPOR GENERATOR AND METHOD OF FABRICATION THEREOF

(76) Inventor: Max Friedheim, P.O. Box 99838, San Francisco, CA (US) 92169

( * ) Notice: Under 35 U.S.C. 154(b), the term of this patent shall be extended for 0 days.

(21) Appl. No.: 08/484,019

(22) Filed: Jun. 7, 1995

(51) Int. Cl.[7] ..... B01D 3/06; A61H 33/06; F22G 7/14

(52) U.S. Cl. ..... 392/399; 392/394

(58) Field of Search ..... 392/386, 394, 392/396, 398–399, 401, 402, 403, 404, 405; 38/77.9, 77.83; 122/40, 476, 460, 466, 467

(56) References Cited

U.S. PATENT DOCUMENTS 3,721,802 * 3/1973 Chrisman ..... 392/399
4,414,037 * 11/1983 Friedheim ..... 392/399
5,471,556 * 11/1995 Friedheim ..... 392/399

* cited by examiner

*Primary Examiner*—Sang Paik
(74) *Attorney, Agent, or Firm*—Evanns & Walsh; Joseph R. Evanns

(57) ABSTRACT

An improved superheated vapor generator for generating superheated vapor comprises a vapor generating volume for receiving liquid and including a vaporization member having a portion defining a plurality of holes for vaporizing contact with the liquid. The widths and/or depths of the holes may vary substantially randomly. The vaporization member may define grooves and ridges of substantially randomly varying height and depth and may further include intersecting grooves and ridges, intersecting the first-mentioned ridges and grooves, these ridges and grooves varying substantially randomly in height and depth. Two or more vapor generators may be arranged such that the vapor generated thereby and vapor pressure are additive. A method for fabricating an improved vapor generator comprises the steps of providing two thermally conductive parts with hollow interiors including at least one vaporization member defining a plurality of holes and welding the two parts together; the vapor generator may be composed of aluminum, stainless steel or other thermally conductive material.

24 Claims, 3 Drawing Sheets

SUPERHEATED VAPOR GENERATOR AND METHOD OF FABRICATION THEREOF

FIELD OF THE INVENTION

The invention pertains to an improved generator for rapid generation of superheated vapor such as superheated steam and further relates to a method for fabricating means for generating superheated vapor.

DESCRIPTION OF THE PRIOR ART

Prior patents include U.S. Pat. No. 4,414,037, owned by the inventor and applicant herein, co-pending U.S. patent application Ser. No. 08/093,071 owned by the inventor and applicant herein for Superheated Vapor Generator and Control System and Method (incorporated by reference herein), references cited in connection with aforesaid U.S. Pat. No. 4,414,037 including U.S. Pat. Nos. 2,505,656; 2,753,212; 2,861,838; 2,983,450; 3,039,454; 3,218,741; 3,718,805; and 3,721,802, and patents cited in connection with said co-pending U.S. Pat. Nos. 3,721,802, 2,652,645, 3,436,852, 377,228, 3,119,004, 3,869,815, 4,255,646. 3,508,354, 3,823, 497, 2,576,976.

The aforesaid patents in the main refer to apparatus for generating steam from liquid drawn from a reservoir.

U.S. Pat. No. 4,414,037 (the '037 Patent) to the inventor herein discloses apparatus for generating superheated steam or other vapor from water drawn from a self-contained reservoir and includes means in the form of a nozzle for directing superheated steam to desired objects. The apparatus disclosed and claimed in the aforesaid patent is directed to a system for accomplishing, among other things, cleaning and sterilization, the mixture drawn from the reservoir in particular applications being a cleaning solution or a disinfectant. The device of the '037 patent employs a nozzle positioned adjacent the cover of the device for directing the spray of superheated vapor, under the control of a foot switch whereby the intake and output of steam is regulated. The steam chamber comprises walls having point-like irregularities etched into the surface thereof by etching solution, as a result of which the production of vapor from input fluid is expedited as opposed to steam generation from a smooth-walled chamber. The chamber could be fabricated only of aluminum, due to the chemical process employed in etching the irregularities into the chamber walls. In addition, the device of the '037 patent delivers a uniformly relatively dry mixture of superheated vapor, which was advantageous in a number of applications.

The device of the '037 patent has been highly successful in numerous applications, including cleaning and sterilization of numerous objects such as large and small machinery and medical equipment. However, it was found that improved results and more general applicability could be achieved through a superheated vapor generator and control system which would produce superheated vapor such as steam even more rapidly than the existing device and would in addition afford the capability of greater convenience and mobility, and more precise control in terms of regulating and directing the flow of superheated fluid. In addition, it has been found in particular applications that regulation of moisture (i.e. liquid) content of the superheated vapor is of moment. The invention in the co-pending application includes an improved structure and method regarding the vapor generator chamber and configuration of the walls thereof as well as a method for fabricating such improved structure, and further refers to an improved control system for controlling and directing the stream of superheated vapor.

It has been found that further improved results can be obtained by means of a superheated vapor generator capable of generating superheated vapor such as steam more efficiently and rapidly and efficiently than the generator in the '437 patent and in the co-pending application, and that in particular applications such increased rapidity and efficiency of vaporization is preferable. Thus, there has been a felt but unfulfilled need for a high-efficiency superheated vapor generator and method of fabrication thereof.

SUMMARY OF THE INVENTION

A superheated vapor generator for generating superheated vapor comprising a vapor generating volume for entry thereinto of liquid for vaporization, the vapor generating volume including at least one vaporization member including a portion defining a plurality of holes for vaporizing contact with the liquid. The widths and/or depths of the holes may vary substantially randomly.

The vaporization member may comprise a wall of such vaporization chamber or a thermally conductive member within the vaporization chamber, among other configurations in accordance with the invention.

The vaporization member may define a plurality of ridges and grooves of substantially randomly varying depths and heights. Transverse ridges and grooves intersecting the first-mentioned ridges and grooves may be employed, with the transverse ridges and grooves varying substantially randomly in height and depth.

Two or more superheated vapor generators in accordance with the invention may be connected such that the vapor and vapor pressure generated thereby are substantially additive.

A method for fabricating a superheated vapor generator comprises the steps of providing two thermally conductive parts with hollow interiors including at least one vaporization member defining a plurality of holes, and welding the two parts together.

DETAILED DESCRIPTION OF THE INVENTION

Figure 1:
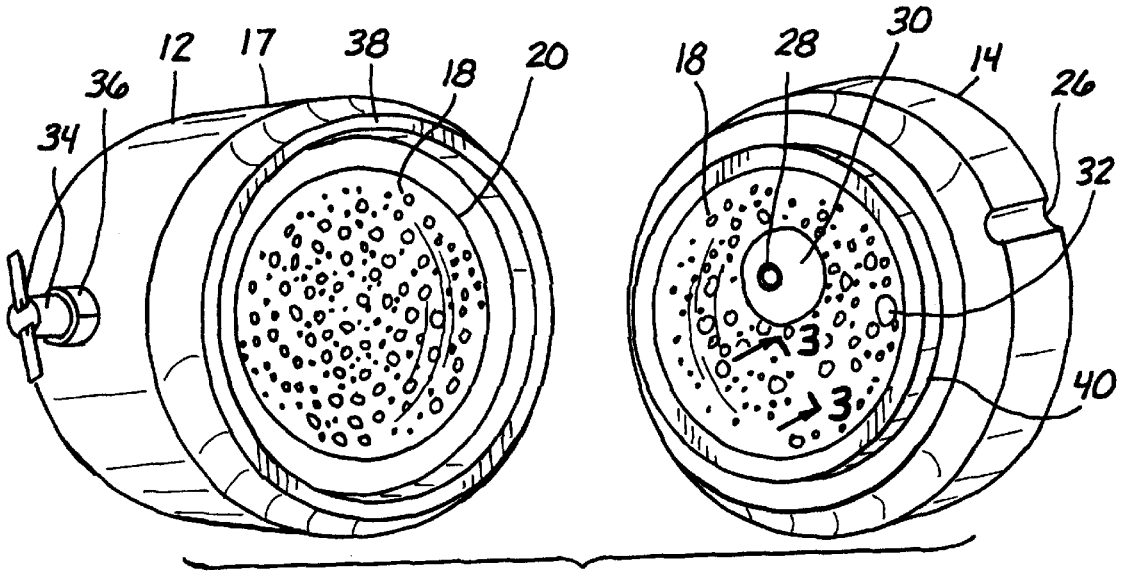
FIG. 1 is a perspective view of a superheated vapor generator in accordance with the inventions depicting said generator in two parts.
Figure 2:
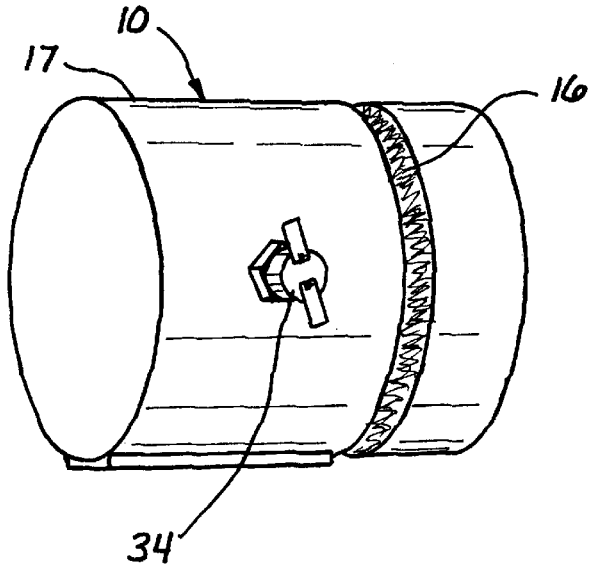
FIG. 2 is a perspective view of the superheated vapor generator in accordance with the invention depicted in FIG. 1, depicted assembled.
Figure 3:
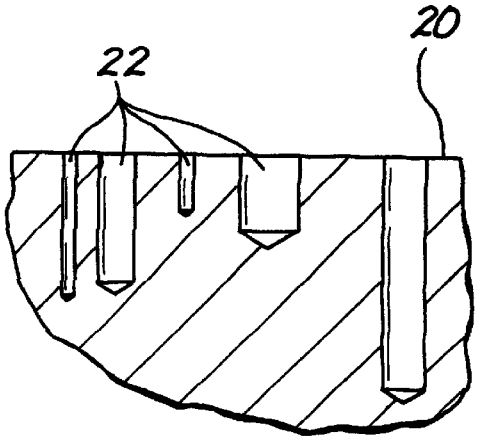
FIG. 3 is a section of the vapor generator in accordance with the invention depicted in FIG. 1, taken along the line 3—3 of FIG. 1.

Referring to FIGS. 1–3, inclusive, a superheated vapor generator 10 comprises a pair of metal castings in two sections 12, 14, nestable with one another and welded together at weld 16. The welded-together generator 10 is of generally cylindrical exterior configuration though, of course, in accordance with the invention other shapes may be employed in particular applications.

Vapor generator 10 comprises a body or housing 17 which defines centrally therein a vaporization chamber 18. Chamber 18 as depicted is substantially spherical; however, in particular applications, other configurations may be employed in accordance with the invention. In the depicted spherical configuration, the periphery 20 of vaporization space 18 comprises a single wall. In other configurations in accordance with the invention, such periphery may comprise more than one wall or may be in sections, as for example, in a rectangular or polyhedral configuration. In the depicted embodiment, the wall 20 functions as a vaporization member or surface; in other embodiments of the invention (see FIG. 5), the vaporization surface or surfaces may be disposed within chamber 18 and may not comprise a wall but may for example, constitute a heatable member thermally coupled to the housing 17 or wall 20, or both. In particular applications, such internal vaporization member may comprise a tetrahedral configuration (having as depicted a substantially rectangular contour) and may be employed in addition to or as an alternative to other configurations and locations of vaporization members, including the depicted wall configuration and location.

Wall surface 20 of chamber 18 defines a plurality of holes 22. Holes 22 are of randomly varying depth and diameter, as best seen in FIG. 3.

In particular applications of the invention, the depth of holes 22 varies substantially randomly between substantially 0.200 inch and 0.312 inch, while the diameters vary from substantially 5/32 inch to 5/16 inch. Other depth and diameter ranges may be employed in accordance with the invention.

It has been discovered that such variation in the diameters and depths of the holes 22 defined by the vaporization member in the form of inner wall 20 of chamber 18 produces highly efficient and rapid vapor generation upon introduction of a liquid to be vaporized into chamber 18. In this context, efficiency refers to the degree of completeness of vaporization i.e. the less liquid remains unvaporized in the exudate, the greater the efficiency. It has further been discovered that the aforesaid highly rapid and efficient results are increased when the holes 22 vary substantially randomly in both depth and diameter; however, these dimensional variations are employable independently of one another and need not be employed concurrently. In particular applications of the invention, rapid and efficient vaporization has been achieved by variation of the depth alone or the diameter alone. Random distribution of hole sizes with respect to location has been found to promote rapidity and efficiency of operation.

In many respects, vapor generator 10 is similar to the vapor generator described, depicted and claimed in the aforesaid pending patent application Ser. No. 08/093,071. Thus, the description of the remaining features of the vapor generator 10 will be stated briefly and with reference to the aforesaid pending patent application, which is incorporated by reference herein.

A weld identifier marker slot 26 is defined in the periphery of body 17 of vapor generator 10. Defined in generator body 17 are inlet aperture 28 in a weld area 30 on wall 20, and outlet aperture 32. Slot 26 is provided for the purpose of enabling, during welding, lining up of slot 26 with its counterpart (not shown) on part 12 of vapor generator 10 in the unassembled state in order to orient the respective sections properly. Such proper orientation entails the desired placement of inlet aperture 28 within weld area 30 and location of outlet aperture 32. Inlet 28 is connectable to a source (not shown) of liquid, such as water, and outlet 32 is connectable to means (not shown) for directing expelled vapor. The connection of inlet aperture 28 to a source of liquid and outlet aperture 32 to vapor control means may in particular applications be as disclosed in the aforesaid co-pending patent application.

A thermostat 34 is affixed to a receptacle 36 in body 17, whose function as described in said pending patent application is to control temperature of the vapor generator 10. Other temperature control means, such as thermocouples, may be employed in accordance with the invention. As also described in the co-pending application, the heating of vapor generator 10 is accomplished by a heating cartridge (not shown), preferably electrically-powered, disposed in a receptacle (not shown) in body 10.

As best seen in FIG. 1, parts 12,14 include mating flanges 38, 40 such that, in the depicted embodiment, the flange 40 of part 14 is fittable into flange 38 of part 12. In this manner, when welding takes place, the weld is secure and engagement is tightened as a result of the engagement of the flanges 38, 40.

Figure 4:
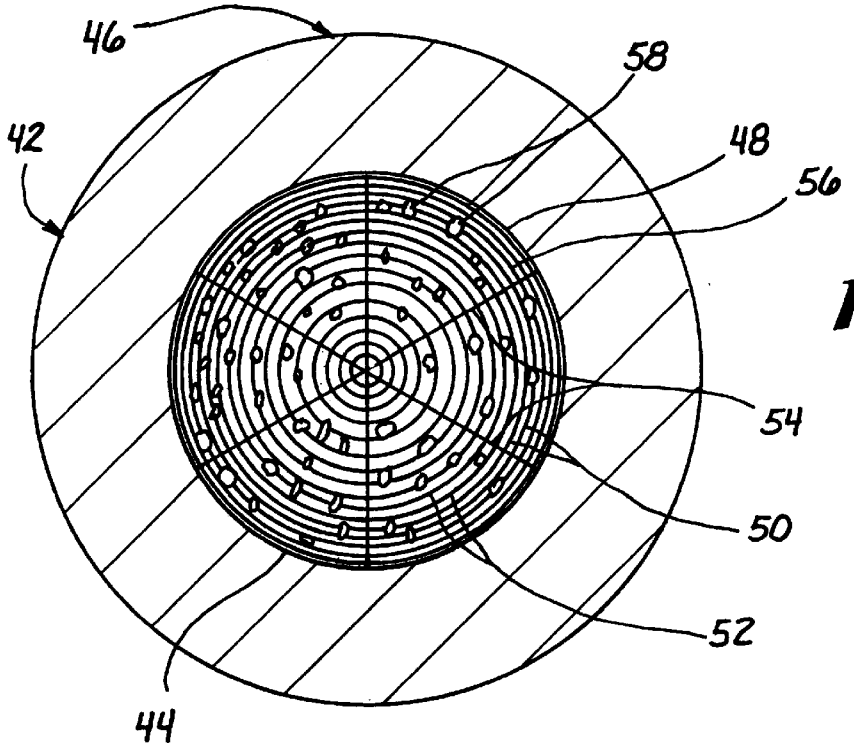
FIG. 4 is a sectional view of an alternative embodiment of the invention.
Figure 5:
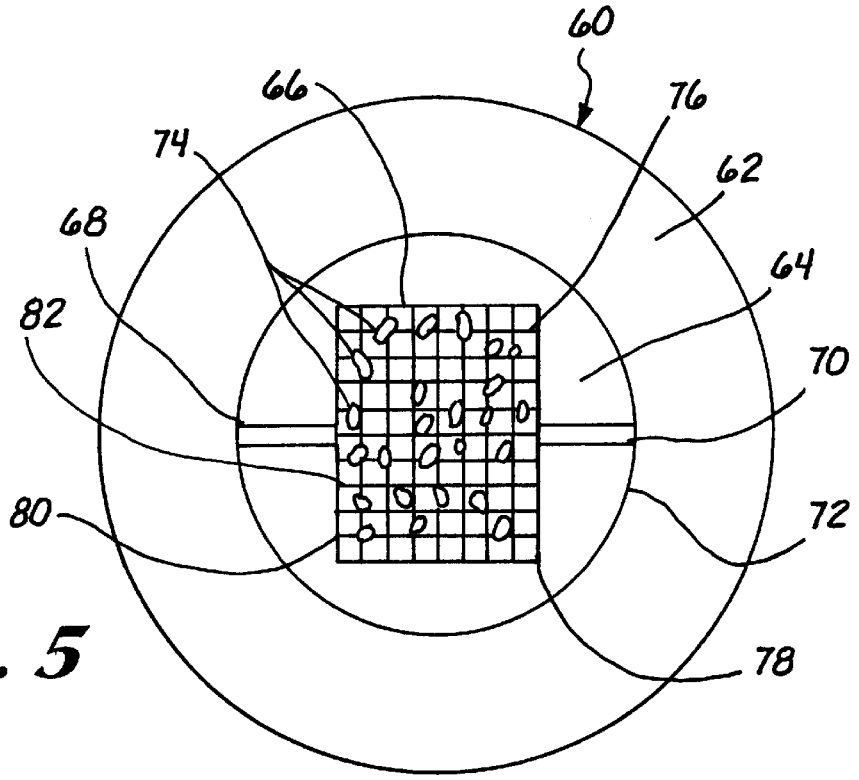
FIG. 5 is a sectional view, somewhat simplified, of a further alternative embodiment of the invention.

Referring now to FIG. 4, an alternative embodiment of the invention is shown comprising a sectional view of a vapor generator 42 depicting the interior thereof. As depicted in FIG. 5, vapor generator 42 defines an internal volume in the form of a vaporization chamber 44 as in the embodiment of FIGS. 1–4, the vapor generator 42 being formed from two generally cylindrical parts, of which one, corresponding to part 12, and designated with reference numeral 46 herein, is depicted. Vaporization chamber 44 includes a peripheral wall 48. In wall 48 are defined a plurality of ridges and grooves 50, 52, respectively. The heights of the ridges 50 and the depths of the grooves 52 vary substantially randomly 0.030–0.050 inch, and the ridges and grooves 50, 52 are generally circumferential.

As depicted, defined in wall 48 of chamber 46 are a plurality of transverse ridges and grooves 54, 56 substantially radially directed from the center of chamber 44. As depicted, cross-grain ridges and grooves 54, 56 comprise a plurality; however, in particular applications there may be only one such cross-grain ridge and groove. Cross-grain ridges and grooves 54, 56 are, like ridges and grooves 50, 52, of substantially random and irregular dimensions. Ridges and grooves 54, 56 vary substantially randomly between 0.020 and 0.050 inch. A plurality of holes 58 are defined in wall 48. Holes 58 vary substantially randomly in depth and width in the same manner as holes 22 in the embodiment of FIGS. 1–3, inclusive.

It has been found that the presence of the ridges and grooves 50, 52 augments efficiency and rapidity of vaporization and that the presence of the transverse ridges and grooves 54, 56 has a similar effect.

Thus, in particular applications, the efficiency of a vapor generator employing holes may be increased by the presence of ridges and grooves 50, 52 and/or transverse ridges and grooves 54, 56.

Referring now to FIG. 5, a further alternative embodiment of the invention is depicted therein. A vapor generator 60 includes a body 62 and vaporization chamber 64 in the same manner as in the above-referred embodiments.

Disposed in vaporization chamber 64 is vaporization member 66. Member 66 has a generally rectangular cross-section as depicted, though in particular applications alternative configurations may be employed. Member 66 includes thermally conductive connector members 68, 70 thermally connecting member 66 to a wall 72 of chamber 64.

Member 66 defines a plurality of holes 74. Like the holes depicted in vaporization members in the above-discussed embodiments, holes 74 vary substantially randomly in dimensions and distribution of dimensions.

Defined in vaporization member 66 are a plurality of ridges and grooves 76,78. Ridges and grooves 76, 78 like their counterparts in the embodiments described above vary substantially randomly in height and depth. Also defined in vaporization member 66 is a plurality of transverse ridges grooves 80, 82 substantially transverse to ridges and grooves 76, 78; these also vary substantially randomly in height and depth, like their counterparts discussed hereinabove.

As in the embodiments discussed above, grooves and ridges 76, 78 and transverse grooves and ridges 80, 82 may be employed separately or together with or without holes 74 for efficiency and rapidity of vaporization.

Figure 6:
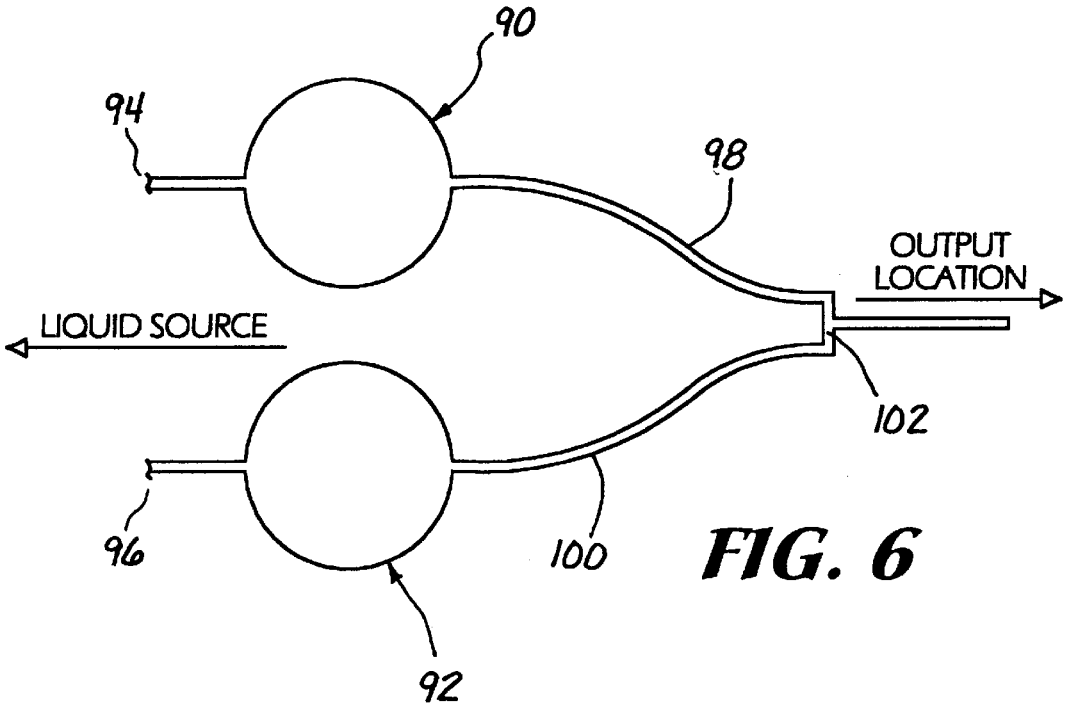
FIG. 6 schematically depicts a combination of a plurality of vapor generators in accordance with the invention.

Referring now to FIG. 6, depicted schematically therein are vapor generators 90, 92 connected by inlet conduits 94, 96 respectively, to sources of liquid (not shown). Outlet conduits 98, 100 emanate from vapor generators 90, 92, respectively. Outlet conduits 98, 100 accommodate vapor expelled from generators 90, 92 and intersect a common outlet conduit 102 connectable, for example, to output location such as vapor control means (not shown). In this manner, vapor and vapor pressure such as steam pressure, issuing from individual vapor generators are rendered substantially cumulative. In this manner, by employing vapor generators in combination, volume and pressure of vapor can be controlled, expanded and reduced as desired, rendering applications requiring relatively large volumes and pressures, such as power stations, feasible.

Vapor generators in accordance with the invention may be used in a wide variety of applications wherein there is need for apparatus for producing superheated vapor very rapidly and efficiently from liquid. A particular application is disclosed in detail in the aforesaid pending patent application for Superheated Vapor Generator and Control System and Method, and operation of such system is described in detail therein; thus, the description herein will be brief. As disclosed in the aforesaid patent application, a vapor generator in accordance with the invention is connectable to control means and couplable to a reservoir of fluid to be vaporized. The vapor generator is heated to a preset and controlled superheated temperature e.g. 500° F., and superheated vapor generator in accordance with the present invention may be employed in the system of the earlier-filed patent application. In operation, control means cause liquid from a reservoir (not shown) to be drawn into inlet 28 of vapor generator 10; in vapor generator 10 the liquid is very rapidly and efficiently converted to vapor.

Vapor is expelled through outlet 32 and may be directed to a desired location by a nozzle as described in said pending patent application or by other means.

It has been found that liquid on vaporization surfaces configured in accordance with the invention does not exhibit "beading" activity to the extent this occurs on superheated surfaces lacking surface configuration in accordance with the invention, such "beading" activity comprising the well-known phenomenon of a droplet of fluid on a heated surface appearing to "bounce" from place to place on the surface.

Liquid employed in connection with the invention may be of a wide variety. For cleaning, water may be employed, and superheated steam generated in accordance with the invention may be used to loosen or dissolve dirt on, for example, machine surfaces, circuit boards, or in living or work areas. Additives stable at operating temperatures of vapor generators in accordance with the invention, such as detergents or disinfectants, may be employed. The solution may contain vaporizers, emulsifiers, degreasers, oxidants, alkalis, deodorizers, antiseptics, germicides or the like. Other components of the solution may comprise humidifiers, fresheners, and other reagents to be injected into the air or onto a surface or object. Proportions of additives and solvent may be adjusted in particular applications.

Particular applications comprise cleaning of equipment, circuit boards and/or surfaces and spaces such as rooms in connection with maintenance or janitorial work.

Superheated vapor generators in accordance with the invention may be employed in connection with burnishing or cleaning of small parts such as timepiece apparatus, in connection with metal plating, printing and photo-engraving, lapidary and stonecutting activity, manufacture and/or repair of electronic components, removal of such things as wallpaper, labels and the like, in connection with dry-cleaning, sanitizing and sterilizing of eating implements, in connection with optical and optometric laboratory and office work, with jewelry, dental and medical offices and operating theatres,miniature instrument manufacture and repair, and biological and analytic laboratories, among many other applications.

A particularly useful application of the invention is in connection with cleaning and maintenance of military equipment, including weapons and related items. This has become timely in view of the current emphasis on repair and maintenance as opposed to acquisition of new items.

Superheated vapor may issue at approximately 150 PSI from a vapor generator in accordance with the invention. The superheated vapor impinges upon, and into such relatively hard-to-reach spaces as portholes, crevices, and the like. Application of heat causes contaminants to soften, liquify, and generally decompose or disengage from the surfaces on which they are disposed. This applies to such normally hard-to-clean substances as grease, oil, grime, paste, glue, and carbon. A burst of superheated vapor, such as steam used in cleaning, lasting 5–10 seconds, is sufficient for many cleaning purposes. In particular applications, bursts of superheated vapor produced by the system 10 will last approximately 15–30 seconds. When vapor generators are combined as described in connection with FIG. 6, exudate of vapor/steam may be at such pressures as may be necessary for cleaning or other applications For removal of tenacious contaminants, heat applied by the invention initiates cleaning after which a cleaner or emulsifier may be applied, at which point a further application of superheated vapor from the invention completes removal of the contaminant.

Other applications for the invention are, among others, lubrication, particularly of relatively inaccessible and small parts. Lubrication applied in this manner is effective hot lubrication, the surface having been first cleaned by use of the invention in a cleaning mode, and lubricant being applicable by disposing lubricant on the now clean, heated parts by conventional means the part then being subjected to a stream of superheated vapor, causing the lubricant to be dispersed evenly throughout and upon the object to be lubricated.

Figure 7:
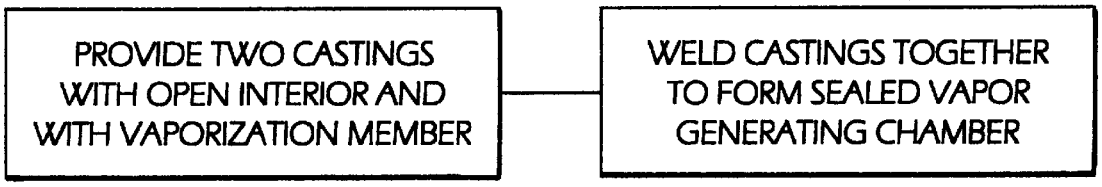
FIG. 7 is a schematic diagram of a method for fabricating a superheated vapor generator in accordance with the invention.

A method for fabricating a superheated vapor generator in accordance with the invention is depicted FIG. 7. Two separate, preferably semicylindrical, bodies in the form of castings are provided. The castings will have been fabricated to define the holes (and ridges and grooves, if desired) described hereinabove. The parts are then welded together, forming a superheated vapor generator in accordance with the invention. The parts and therefore the vapor generator may be composed of aluminum or stainless steel or other heat-conductive material. Alternatively, the bodies may be machined, as opposed to being castings.

As described above, an improved superheated vapor generator and a method for fabrication thereof, have been provided. Though particular embodiments are described and depicted herein, the invention and the scope thereof are defined by the appended claims interpreted in light of the specification and drawings.

What is claimed is:

1. A superheated vapor generator for generating superheated vapor comprising:

a vapor generating volume for entry thereinto of liquid to be vaporized, said vapor generating volume including at least one vaporization member, said at least one vaporization member including a portion for vaporizing contact with said liquid, said portion defining a plurality of holes, said holes having substantially circular cross-section.

2. The invention as set forth in claim 1 wherein the depths of said holes vary substantially randomly.

3. The invention as set forth in claim 1 wherein said holes vary in width substantially randomly.

4. The invention as set forth in claim 1 wherein at least one vaporization member defines a plurality of ridges and grooves whose height and depth vary substantially randomly.

5. The invention as set forth in claim 4 wherein said height and depth of said ridges and grooves are substantially in the range 0.030–0.050 inch.

6. The invention as set forth in claim 5 wherein said vaporization member defines a plurality of ridges and grooves intersecting said first-mentioned ridges and grooves.

7. The invention as set forth in claim 6 wherein said ridges and grooves intersecting said first-mentioned grooves and ridges vary substantially randomly in height and depth.

8. The invention as set forth in claim 7 wherein height and depth of said intersecting ridges and grooves is substantially between 0.030–0.050 inch.

9. The invention as set forth in claim 5 wherein said vaporization member defines at least one ridge and groove intersecting said first-mentioned ridges and grooves.

10. The invention as set forth in claim 1 wherein said superheated vapor generator includes a body, said body defining said vapor generating volume therein, and wherein said vaporization member comprises at least one wall of said vapor generating volume.

11. A superheated vapor generator system for generating superheated vapor comprising: a vapor generating volume for entry thereinto of liquid to be vaporized, said vapor generating volume including at least one vaporization member, said at least one vaporization member including a portion for vaporizing contact with said liquid, said portion defining a plurality of holes, and further including at least one additional vapor generator, said first-mentioned vapor generator and second-mentioned at least one vapor generator being arranged such that vapor and vapor pressure generated by said generators is substantially additive.

12. A superheated vapor generator system for generating superheated vapor comprising: a body substantially composed of thermally conductive material and defining at least one inlet aperture for intake of liquid and at least one outlet aperture for passage therethrough of vapor from said vapor generating chamber; a vapor generating chamber defined within said body, said vapor generating chamber including at least one wall, said at least one wall defining a plurality of holes therein, and including at least one additional vapor generator, said first-mentioned vapor generator and said at least one additional vapor generator being connected such that vapor and vapor pressure generated thereby are substantially additive.

13. A method for fabricating a vapor generator comprising the steps of:

(1) providing two thermally conductive parts with hollow interiors including at least one vaporizing member defining a plurality of holes, said holes having substantially circular cross-section; and (2) welding said parts together to form a sealed vapor generating chamber.

14. The method set forth in claim 13 wherein said holes vary substantially randomly in depth.

15. The method set forth in claim 13 wherein said holes vary substantially randomly in width.

16. The method set forth in claim 13 wherein at least one of said parts defines a plurality of ridges and grooves.

17. The method set forth in claim 16 wherein said ridges and grooves vary in height and depth substantially randomly.

18. The method set forth in claim 17 wherein the height and depth of said ridges and grooves is in the range of 0.030 inch to 0.050 inch.

19. The method set forth in claim 16 wherein said at least one part defines at least one ridge and groove transverse to said first-mentioned ridges and grooves.

20. The method set forth in claim 16 wherein said at least one part defines a plurality of ridges and grooves transverse to said first-mentioned ridges and grooves, the height and depth of said transverse ridges and grooves varying substantially randomly.

21. The method set forth in claim 20 wherein the height and depth of said transverse ridges and grooves is substantially in the range 0.030 inch to 0.050 inch.

22. The method set forth in claim 13 wherein said parts are substantially composed of steel.

23. The method as set forth in claim 13 wherein said parts are substantially composed of thermally conductive material.

24. A method for fabricating a vapor generator comprising the steps of:

(1) providing two thermally conductive parts with hollow interiors including at least one vaporizing member defining a plurality of holes; and (2) welding said parts together to form a sealed vapor generating chamber, at least two vapor generators being connected such that vapor issuing from said at least two vapor generators is substantially cumulative.

* * * * *